United States Patent [19]

Aves, Jr.

[11] Patent Number: 4,495,005

[45] Date of Patent: Jan. 22, 1985

[54] CARBOSILICONIZING FERROUS SUBSTRATES

[75] Inventor: William L. Aves, Jr., Arlington, Tex.

[73] Assignee: Dresser Industries, Inc., Dallas, Tex.

[21] Appl. No.: 547,184

[22] Filed: Oct. 31, 1983

[51] Int. Cl.[3] ..... C21D 9/22

[52] U.S. Cl. ..... 148/16.5; 148/6; 148/15.5; 148/19; 148/31

[58] Field of Search ..... 148/16.5, 6, 15.5, 19, 148/31

[56] References Cited

U.S. PATENT DOCUMENTS

| | | | |
|---|---|---|---|
| 3,842,921 | 10/1974 | Dill et al. | 175/374 |
| 3,922,038 | 11/1975 | Scales | 308/8.2 |
| 3,923,348 | 12/1975 | Peck | 308/8.2 |
| 4,012,238 | 3/1977 | Scales | 148/6 |
| 4,102,838 | 7/1978 | Scales | 148/16.5 |
| 4,188,242 | 2/1980 | Scales | 148/15.5 |
| 4,237,184 | 12/1980 | Gonseth et al. | 148/16.5 |

*Primary Examiner*—Veronica O'Keefe

*Attorney, Agent, or Firm*—Fred A. Winans

[57] ABSTRACT

A process is disclosed for case hardening a ferrous metal. In the invention, the surface of the ferrous metal is exposed to diffusible carbon, boron and silicon in a furnace during multiple stages of a single thermal cycle. The furnace is maintained at a first temperature which enhances diffusion of the carbon to create a carburized substrate to a desired depth. The furnace temperature is then elevated to a second temperature to enhance diffusion of the boron and silicon to form an outer surface layer enriched with these elements. This results in a gradual transition between the carburized substrate and the boronized and siliconized layer.

16 Claims, 2 Drawing Figures

TIME AT TEMPERATURE PROFILE(REPRESENTATIVE) FOR CARBORO-SILICONIZING

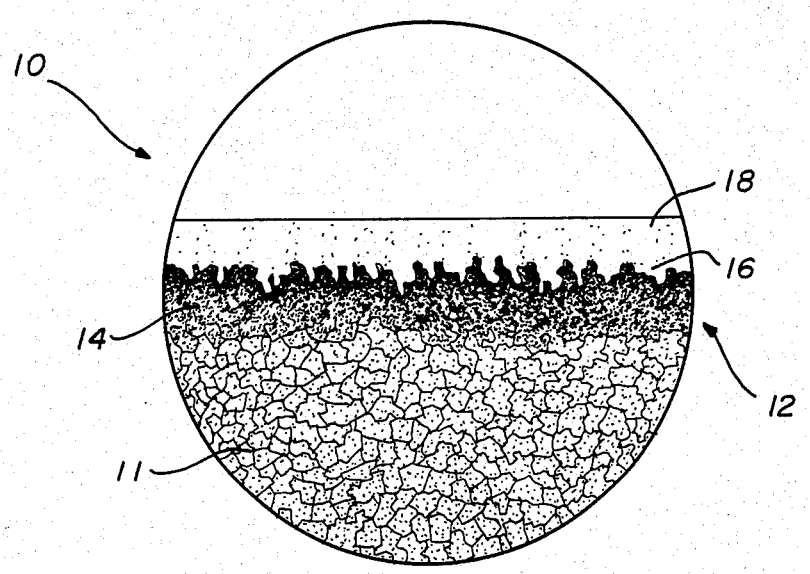
FIG. 1
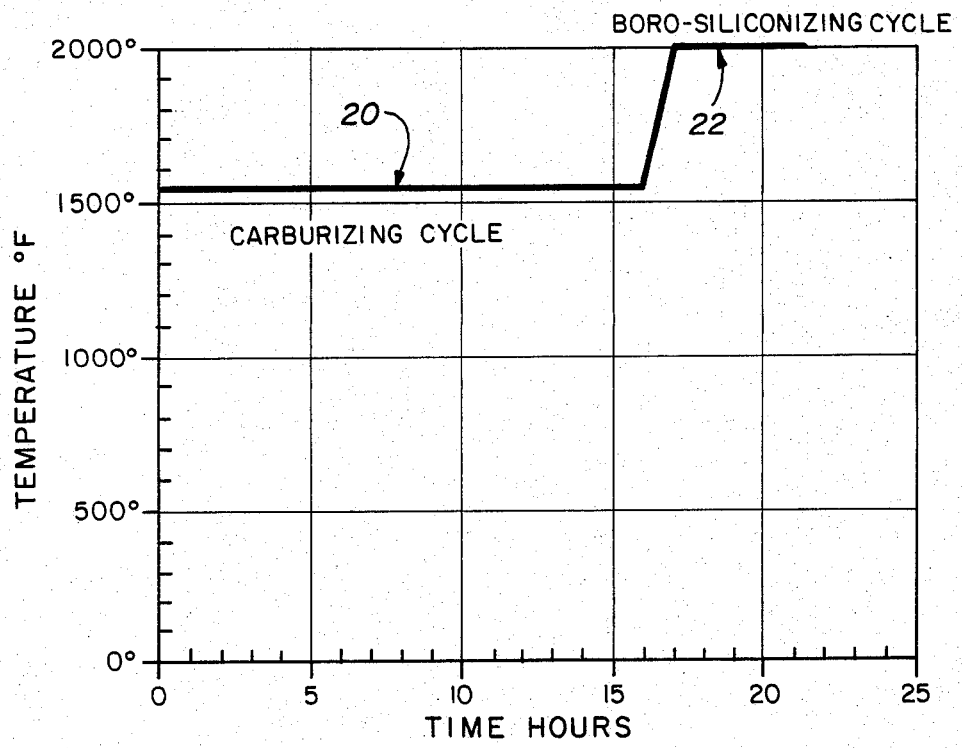
FIG. 2 TIME AT TEMPERATURE PROFILE (REPRESENTATIVE) FOR CARBORO-SILICONIZING

CARBOSILICONIZING FERROUS SUBSTRATES

TECHNICAL FIELD

This invention relates to the treatment of ferrous materials, and in particular to the formation of a hard, wear resistant surface.

BACKGROUND ART

Ferrous metals are often used in environments where the surface is exposed to abrasive and corrosive elements. For example, in drilling oil wells, the wear surfaces of downhole earth boring equipment, such as rotary bits, drilling tools and the components thereof are exposed to the highly abrasive activity of drilling in an environment laden with corrosive elements, often at elevated temperatures.

The desire to create a hard outer surface to resist the abrasion and corrosion, while maintaining a ductile interior, has led to the science of case hardening of metals. In case hardening, a process is used which will produce a hard outer surface or case on a metal while permitting the core of the metal within to remain relatively soft and ductile when subject to normal ferrous metal through treatments.

One common process of case hardening is carburizing. Carburizing is particularly effective with low carbon and alloy steels and permits selective surface hardening of the metals. Carburizing consists of the process of diffusing nascent carbon into a ferrous surface at an elevated temperature. The depth of penetration of the nascent carbon depends upon the temperature and the length of time the ferrous material is exposed to a source of the carbon. The carbon can be supplied to the metal by a number of techniques. The ferrous surface can be exposed to a carbon rich gas or liquid. The material can also be surrounded by solid carburizing compounds to perform a pack carburization.

Ferrous metals have been treated with other materials than carbon. For example, ferrous metals have been exposed to a silicon rich environment which diffuses the silicon into the surface of the ferrous metal. This siliconization produces an outer case having both corrosion and wear resistance properties. Siliconization apparently produces a surface that is impervious to environmental attack as the iron atoms are no longer exposed at the surface.

Ferrous metals have also been treated with boron. If boron is diffused into the outer surface of a ferrous metal, the case becomes more resistant to corrosion with an improvement in the wear resistance of the outer surface resulting from the increase in hardness of the case surface.

Several attempts have been made to combine the desirable features of each case hardening material by hardening a ferrous substrate with multiple materials. For example, U.S. Pat. No. 3,923,348 issued to Peck on Dec. 2, 1975 discloses a technique for hardening a bushing. The bushing has a ferrite and martensite core. A carbon diffused layer is then provided on the ferrous substrate followed by a boron case. U.S. Pat. No. 3,922,038 to Scales issued on Nov. 25, 1975 discloses a treatment for ferrous substrates. In this technique, the ferrous surface is initially carburized. The ferrous material after carburizing is then boronized. Finally, the material is hardened and tempered. U.S. Pat. No. 4,188,242 to Scales issued on Feb. 12, 1980 also discloses a method of carburizing and boronizing steel with subsequent hardening and tempering.

Several shortcomings have been noted in the processes disclosed in these patents. The boron surface layer is extremely brittle and subject to cracking. While this problem can be somewhat alleviated by placing the boron layer in compression, this limits the applications of the process. In addition, it has been found that the boron case thickness must be maintained within a specified range to avoid cracking, restricting the versatility of the process. Therefore, a need exists for a process which combines the advantages of the various case materials which overcomes the shortcomings of the prior techniques.

SUMMARY OF THE INVENTION

In accordance with one aspect of the present invention, a method for treating ferrous metals is provided. The method includes the step of exposing the metal to diffusible carbon, boron and silicon at separate stages during a single thermal cycle. The method further comprises the step of controlling the conditions at the metal surface to initially carburize the metal and subsequently boronize and siliconize the metal, forming a gradual transition from the carburized to boronized and siliconized layers.

In accordance with another aspect of the present invention, a ferrous member is provided. The ferrous member includes an outer surface having a carburized substrate and a boronized and siliconized outer layer. A gradual transition between the carburized substrate and boronized and siliconized outer layer is provided by exposing the ferrous metal to diffusible carbon, boron and silicon at separate stages of a single thermal cycle without an intermediate cooling stage between carbon and boron diffusion and controlling the conditions at the ferrous member to initially carburize the member and subsequently boronize and siliconize the member.

In accordance with yet another aspect of the present invention, a method for treating a ferrous metal is provided. The method includes the step of exposing the ferrous metal to diffusible carbon, boron and silicon during separate stages of the same thermal cycle without cooling intermediate to the diffusion of carbon and boron. The method further includes the step of varying the temperature of the ferrous metal surface to create a carbon rich substrate, an intermediate layer rich with $B_6Si$, SiC, $Fe_2B$ and FeSi and an upper layer rich with $B_3Si$, $B_4C$, SiC, FeB and FeSi with a gradual transition between each layer to enhance the heat treatability of the ferrous metal.

BRIEF DESCRIPTION OF THE DRAWINGS

A more complete understanding of the invention can be had by reference to the following Detailed Description when taken in conjunction with the accompanying Drawings, wherein:

FIG. 1 is a representation of a photomicrograph of a ferrous metal after treatment by a process conducted with the teachings of the present invention; and FIG. 2 is a graph of the temperature at the surface of a ferrous metal plotted against time during treatment by the process.

DETAILED DESCRIPTION

With reference to FIG. 1, a representation of a photomicrograph of ferrous metal member 10 is illustrated. The ferrous metal member 10 can be a part of some useful structure, and preferably comprises a low carbon or alloy steel base metal 11. The ferrous metal member has been treated in a manner described hereinafter to create a surface layer 12 as seen in FIG. 1 which makes surface layer 12 particularly suitable for use as a wear surface. The surface layer 12 includes a carburized substrate 14, an intermediate boronized and siliconized layer 16 and an outer boronized and siliconized layer 18. It will be understood that the transition between base metal 11, substrate 14 and layers 16 and 18 is continuous and gradual due to the process described hereinafter.

The surface layer 12 provides a coating or case for the ferrous metal member 10 which combines the attributes of carburizing, boronizing and siliconizing. The boronizing creates a layer at the surface of exceptional hardness for wear resistance in the presence of the silicon. The carburizing provides a hard substrate (when heat treated) which provides support for the boronized and siliconized surface layer. The siliconizing provides excellent corrosion and acid resistance properties, particularly in the presence of boron. For example, silicon is particularly resistant to hydrogen sulfide and sulphuric acid, two compounds commonly encountered in drilling an oil well. It has also been found that the smooth and gradual transition between substrate 14 and layers 16 and 18 provided by the process described hereinafter alleviates the tendency to brittleness and cracking of the surface layer, even in applications where the outer surface is not in compression.

The purpose of the present invention is to provide for carburizing, boronizing and siliconizing a ferrous metal during separate stages in a single thermal cycle with no intermediate cooling between the carburizing and boronizing siliconizing temperatures. By varying the conditions at the ferrous metal surface, the carburized substrate 14 will be formed initially, with subsequent formation of the intermediate and outer layers 16 and 18. In the preferred embodiment, the temperature at the ferrous metal surface is selected as the variable condition to selectively carburize, boronize and siliconize the metal.

In one process performed under the teachings of the present invention, a 4815 steel, having a carbon content between 0.13 and 0.18%, was treated. A pack composition was employed to form the surface layer 12. This composition consisted of between 5 and 10% amorphous boron, 5–10% silicon powder, 5–15% alkyli earth activated (i.e., sodium fluorosilicide), and 75–85% of a carbon bearing compound. This carbon bearing compound consisted of a homogenous blend of 10–30% barium carbonate, 5–10% calcium carbonate and the remaining 60–85% of a mixture consisting of 80–90% hardwood charcoal and 10–20% coke, all bonded and crushed.

With reference to FIG. 2, the initial, carburizing 20 was performed at a temperature of approximately 1500° F. for a period of approximately 16 hours. The temperature was then increased to approximately 2000° F. in the boronizing and siliconizing portion, as at 22, for the remainder of the process. The carburized substrate 14 is formed during the initial portion 20 of the process, which permits diffusion of primarily carbon into the ferrous metal. The increase in temperature to 2000° F. accelerates the boron and silicon diffusion. It is believed the silicon enhances the boron diffusion, acting in a manner like a catalyst. The silicon also displaces the carbon in the ferrous metal deeper into the substrate 14 to provide further enrichment of the carbon substrate.

The rate of temperature climb from the predominantly carburizing temperature as at 20 to the borosiliconizing temperature as at 22 is generally not critical. When boronization and siliconization are initiated at a temperature above 1600° F., the boronized and siliconized layer inhibits further deposition of the carburized layer. If boron and silicon were not present, carburizing would continue to take place above 1600° F.

Test results were taken from a metal treated under the teachings of the present invention. The layer 14 was found to have been approximately 0.012" thick. The coating hardness was measured with a 200 gm load on a Wilson, Tukon microhardness tester at KHN (Knoop Hardness Number) 1180, 1310, 1333 and 1344 in four measurements. The hardness of the base metal 11 at various depths from the surface are recorded below:

| Depth from Surface | Hardness (Rockwell "C") |
|---|---|
| .017–.020" | 41 to 50 |
| .025–.035 | 41 to 44 |
| .040 to core | 33 to 40 |

The substrate 14 would be expected to have a Vicker's hardness number in the range from 700 to 1000. The base metal will typically have a Vicker's hardness number in the range of 500 to 700.

Upon treatment under the teaching of the present invention, substrate 14 is carbide enriched. Layer 16 contains high concentrations of $B_6Si$, SiC, $Fe_2B$ and FeSi. Layer 18 contains high concentrations of $B_3Si$, $B_4C$, SiC, FeB and FeSi. Substrate 14 manifests itself as a very find precipitant of iron carbide. Substrate 14 gradually diffuses into the base metal 11. The treatment of the present invention is not believed to alter the grain size of the treated metal, and the grain size is generally uniform in base metal 11 and surface layer 12.

Another advantage of the present invention is the fact that the depth of the surface layer 12 can be better controlled than is possible in the prior art. When multiple heating cycles are used, the reheating of a carburized material drives the carbon deeper into the material, causing a loss of control of the depth of carburization. With the single thermal cycle having multiple stages therein according to the present invention, the depth of surface layer 12 can be better controlled as carbon is not diffused further into the metal member 10 when the temperature is raised for the boron and silicon portion of the cycle. In addition, the layer 12 can have much greater depth. A 0.01 to 0.02 inch (10 to 20 mil) thick layer is possible with the teachings of the present invention while prior art processes do not exceed 0.002 to 0.004 inch (2 to 4 mils) without fear of cracking at the surface.

While this process was found to be effective on 4815 steel, the various compositions and process conditions can be varied to achieve the design requirements desired in the treated material. Potassium fluoride can be substituted for the sodium fluorosilicide. Silicon carbide can be substituted for the silicon powder.

It is further anticipated that an effective composition for a particular steel will be made with the compounds in the following noted weight percentages:

| | |
|---|---|
| amorphous boron | 5–20% |
| silicon powder or silicon carbide | 2–10% |
| alkyli earth | 2–15% |

-continued

| | |
|---|---|
| carbon bearing compound | 70–90% |

The carbon bearing compound can comprise the following compounds in weight percentages:

| | |
|---|---|
| barium carbonate | 5–45% |
| calcium carbonate | 5–20% |
| hardwood charcoal and coke mixture | 50–90% |

The hardwood charcoal and coke mixture can comprise the following compounds in weight percentages:

| | |
|---|---|
| hardwood charcoal | 70–90% |
| coke | 5–20% |

The operational temperature for the carburizing of the metal is most effective in a temperature range between 1400° and 1650° F. The boronizing and siliconizing stage initiates at about 1650° F. and continues to about 2000° F. The optimum temperature for both stages will vary with the core material 11 and relative richness of the pack composition. It is critical to maintain the temperature for carburizing a sufficiently long time to complete carburization since once the boronizing and siliconizing stage is entered, carburizing is effectively stopped.

Although a pack composition was used in the previous example, the advantages of the present invention can be achieved by a diffusion from a gas or fluid rich in carbon, boron and silicon. In gas diffusion, the ferrous metal article to be treated would be placed in the furnace. The temperature would then be raised to the proper temperature for carburizing in the presence of a gas, such as methane, and the temperature would be maintained until the desired carburizing depth is obtained. The furnace would then be purged with an inert gas. After purging, another gas would be introduced into the furnace from which boron and silicon could be liberated and diffused into the surface.

The process of the present invention provides significant commercial advantages since it requires only a single cycle heating process. It is undesirable to do any surface finishing subsequent to case hardening or similar treatment since the finishing would remove portions of the treated surface. It is therefore critical that the surface treatment does not cause dimensional changes which would require subsequent finishing. By eliminating repetitive thermal cycles, the process of the present invention makes it easier to control or eliminate dimensional changes. A multicycle process requires multiple heatings and cool downs of process furnaces, resulting in large and expensive energy costs. In addition, the cycle from high to low temperatures can result in undesirable molecular changes. The present process is versatile and readily adaptable to ferrous metal configurations of a complex nature. Surface layers 12 of a thickness to 0.040 inches (40 mils) and perhaps larger thickness are obtainable. While the prior art is apparently limited to a boron thickness of 0.002–0.004 inches, the present boron coating should be obtainable in thicknesses to 0.01–0.20 inches.

Although a single embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A process for treating ferrous metals comprising the steps of:

exposing the ferrous metal to diffusible carbon, boron and silicon during a single thermal cycle; and controlling the conditions at the ferrous metal surface to initially carburize the ferrous metal surface and subsequently boronize and siliconize the ferrous metal surface, forming a gradual transition between the carburized layer and the boronized and siliconized layer.

2. The ferrous metal having a surface layer formed by the process of claim 1.

3. A process for treating a ferrous metal, comprising the steps of:

exposing the ferrous metal to diffusible carbon, boron and silicon within a single thermal cycle without an intermediate cooling stage; and varying the temperature at the ferrous metal surface to initially enhance diffusion of carbon into the surface to create a carburized substrate to enhance the heat treatability of the ferrous metal and subsequently enhance diffusion of boron and silicon to form a surface layer with a gradual transition between the substrate and surface layer.

4. The process of claim 3 wherein the variation of temperature to enhance boron and silicon diffusion operates to create an intermediate surface layer rich with $B_6Si$, SiC, $Fe_2B$ and FeSi and an upper surface layer rich with $B_3Si$ $B_4C$, SiC, FeB and FeSi.

5. The ferrous metal having a surface layer formed in accordance with the process of claim 3.

6. A process for treating a ferrous metal, comprising the steps of:

exposing the surface of the ferrous metal to diffusible carbon, boron and silicon contained in a composition consisting of 5–20 weight % amorphous boron, 2–10% silicon powder, 2–15% alkyli earth activator, and 70–90% of a carbon bearing compound consisting of a homogenous blend of 10–30% barium carbonate, 5–20% calcium carbonate and the remaining a mixture consisting of 70–90% bonded and crushed hardwood charcoal and coke 5–20%; and varying the temperature at the ferrous metal surface to initially enhance diffusion of carbon to create a carburized substrate to enhance the heat treatability of the ferrous metal and subsequently enhance diffusion of boron and silicon without intermediate cooling to form a surface layer with a gradual transition between the substrate and surface layer.

7. The process of claim 6 wherein said step of varying the temperature includes the step of maintaining the ferrous metal surface at a temperature in the range 1400°–1650° F. for enhanced carbon , diffusion and elevating the temperature to within the range 1650°–2000° F. to enhance boron and silicon diffusion.

8. The method of claim 6 wherein the alkyli earth activator comprises sodiumfluoro silicide.

9. The method of claim 6 wherein said alkyli earth activator comprises potassium fluoride.

10. The process of claim 7 wherein the rate of temperature elevation is set to provide a gradation between the carbide substrate and surface layer to resist surface cracking.

11. The method of claim 6 wherein silicon carbide is substituted for silicon powder.

12. The ferrous metal having a surface treated by the process of claim 6.

13. A ferrous metal, comprising:

an outer surface layer having a carburized substrate and a boronized and siliconized outer surface layer with a gradual transition therebetween formed by exposing the ferrous metal to diffusible carbon, boron and silicon during a single thermal cycle without intermediate cooling between the diffusion of carbon and boron and controlling the thermal conditions at the ferrous metal surface to initially enhance carbon diffusion to form the carburized substrate and subsequently enhance boron and silicon diffusion to form the outer surface layer.

14. A ferrous metal comprising:

an outer surface having a carburized substrate and a boronized and siliconized outer surface layer with a gradual transition therebetween formed by exposing the ferrous metal to diffusible carbon, boron and silicon in a furnace at a first temperature enhancing diffusion of the carbon to form a carburized substrate for improved heat treatability characteristics and subsequently elevating the furnace temperature to a second temperature to enhance diffusion of boron and silicon to form the outer layer, the diffusion of carbon, boron and silicon being performed during a single thermal cycle without intermediate cooling between the first and second temperatures, the elevation of temperature providing a gradual transition between the carburized substrate and outer surface layer.

15. A process for treating a ferrous metal, comprising the steps of:

exposing the ferrous metal to a gas containing diffusible carbon at a first temperature to diffuse carbon into the surface of the ferrous metal to form a carburized substrate;

purging the carbon bearing gas from about the ferrous metal with an inert gas;

exposing the ferrous metal to a gas containing diffusible boron and silicon at a second temperature without cooling of the ferrous metal from the first temperature to form a boron and silicon rich surface layer with a gradual transition between the base metal, carburized substrate and boron and silicon rich surface.

16. The process of claim 15 wherein said carbon bearing gas is methane.

* * * * *